US005544668A

United States Patent [19]

Dollar

[11] Patent Number: 5,544,668

[45] Date of Patent: Aug. 13, 1996

[54] APPARATUS FOR TREATING WORK OBJECTS

[76] Inventor: Arthur J. Dollar, 1216 E. Kelso Ave., Fresno, Calif. 93720

[21] Appl. No.: 215,802

[22] Filed: Mar. 21, 1994

[51] Int. Cl.[6] ..... B08B 3/02

[52] U.S. Cl. ..... 134/104.2; 134/149; 134/153; 134/900

[58] Field of Search ..... 134/104.2, 135, 134/147, 149, 153, 900, 138

[56] References Cited

U.S. PATENT DOCUMENTS

| | | | |
|---|---|---|---|
| 1,811,896 | 6/1931 | Ross | 134/182 |
| 2,725,065 | 11/1955 | Wilsing | 134/900 |
| 2,831,488 | 4/1958 | Anderson . | |
| 3,037,516 | 6/1962 | Leach | 134/900 X |
| 3,428,060 | 2/1969 | Spivey . | |
| 3,577,280 | 5/1971 | George . | |
| 3,688,785 | 9/1972 | Stevens | 134/900 X |
| 3,731,697 | 5/1973 | Yost | 134/900 X |
| 3,886,960 | 6/1975 | Krueger | 134/900 |
| 4,402,333 | 9/1983 | Frizzell et al. | 134/149 |
| 4,641,673 | 2/1987 | Conley et al. . | |
| 4,672,987 | 6/1987 | Brandt . | |
| 4,711,258 | 12/1987 | Rossborough et al. . | |
| 4,809,722 | 3/1989 | Pennise | 134/900 |
| 4,832,066 | 5/1989 | Shipman | 134/900 |
| 5,050,626 | 9/1991 | Brockage et al. . | |
| 5,095,928 | 3/1992 | Phipps | 134/153 |
| 5,184,637 | 2/1993 | Kowis . | |

FOREIGN PATENT DOCUMENTS

| | | | |
|---|---|---|---|
| 2949554 | 6/1981 | Germany | 134/900 |

*Primary Examiner*—Frankie L. Stinson
*Attorney, Agent, or Firm*—Worrel & Worrel

[57] ABSTRACT

An apparatus for treating work objects, the apparatus having a housing with an interior dimensioned to receive the work object therewithin; a source of fluid under pressure for treating the work object; and an assembly for interconnecting the source and the interior of the housing for release of the fluid under pressure from the source into the interior and against the work object substantially along a predetermined axis to treat the work object.

4 Claims, 3 Drawing Sheets

APPARATUS FOR TREATING WORK OBJECTS

BACKGROUND OF THE INVENTION

1. Field of the Invention

The present invention relates to an apparatus for treating work objects and, more particularly, to such an apparatus which is particularly well suited to cleaning paint rollers and the like.

2. Description of the Prior Art

There are a variety of environments in which work objects must be treated with fluids to achieve a given operational result and wherein, conventionally, a multitude of problems severely hamper the operation. For example, paint brushes, paint rollers and related painting equipment are notoriously difficult to clean. The residual paint, varnish, lacquer, stain or other surface treatment substance must completely be removed in order for the equipment again to be usable. Such substances set quickly and, thereafter, become even more difficult, or impossible, to remove. As a consequence, such cleaning operations must be performed on site immediately after the painting operation has been completed. Typically, then, cleaning must be performed in an environment in which dust, dirt and other deleterious substances may adhere to the paint and thereby further exacerbate the cleaning operation.

In the case of paint rollers, it is known to use various devices operable to rinse the paint roller or, more particularly, the sleeve thereof in a suitable solvent. Obviously, water is a suitable solvent for water base paints. However, in the case of oil base paints, flammable substances such as paint and lacquer thinner must be used with the attendant hazards. It is also known to spray the solvent with sufficient velocity forcibly to drive the paint from the sleeve. Still further, it is known to direct the fluid stream at the paint roller at an oblique angle so as to cause the roller to be rotated about its longitudinal axis and thereby to employ centrifugal force in assisting to remove the residual substance from the paint roller.

Such prior art devices are, however, plagued by rather formidable difficulties. Conventionally they employ a manifold having a plurality of fluid release orifices operable to direct the solvent against the paint roller. Because of the number of orifices, the velocity at which the solvent can be projected against the paint roller is typically insufficient adequately to flush the residual substance from the roller, or to rotate the roller at a sufficient velocity that centrifugal force is of much, if any, assistance. Similarly, the volume of solvent which must be employed is such as to present an egregious disposal problem. The solvent, bearing the residual substances removed from the paint roller, constitute a waste material subject to local, state and federal disposal laws and yet there has heretofore been no adequate means for disposing of the waste material. As a consequence, even though violative of law, common practice dictates that the substance is released into buckets or other available containers and discarded in garbage cans, at waste disposal sites, or poured down storm drains. In other instances, the waste material is simply poured on the ground at the job site. The contamination of the environment resulting from such abuses is all too common.

Still another problem which severely limits the utility of such prior art devices is the difficulty in confining the solvent within the device during the cleaning operation. Typically, such devices are not fluid tight and are otherwise incapable of completely containing the solvent during use. The solvent is directed against the paint roller and the internal surfaces of the device and is deflected therefrom so as to be sprayed from the device into the vicinity with predictable consequences. The operator frequently is splattered with the substances and the surrounding areas contaminated thereby.

Therefore, it has long been known that it would be desirable to have an apparatus for treating work objects which is particularly well suited to the cleaning of paint rollers and the like; which is operable to treat the paint roller with a treating substance, such as a suitable solvent, with sufficient velocity completely to remove the residual substances from the paint roller; which operates in such a fashion as to confine the cleaning solvents therewithin to prevent inadvertent release into the environment or on to the operator; which possesses a fully reliable means for disposing of the waste materials resulting therefrom in accordance with local, state and federal laws; and which is otherwise entirely successful in achieving its operational objectives.

SUMMARY OF THE INVENTION

Therefore, it is an object of the present invention to provide an improved apparatus for treating work objects.

Another object is to provide such an apparatus which is particularly well suited to cleaning paint rollers and the like of residual substances such as paint, stain, lacquer, varnish and other surface treatment substances without the problems heretofore associated with prior art devices directed to the same purpose.

Another object is to provide such an apparatus which is operable to employ any desired cleaning solvent in such a manner as to achieve the maximum beneficial effect without the problems heretofore associated therewith.

Another object is to provide such an apparatus which is operable dependably to confine the cleaning solvent and residual substances resulting from the cleaning operation entirely within the apparatus so as to prevent release into the environment.

Another object is to provide such an apparatus which operates to containerize the residual substances resulting from use of the apparatus for disposal in accordance with local, state and federal laws while precluding direct contact therewith by the operator.

Another object is to provide such an apparatus which is convenient and reliable to use while being inexpensive to purchase and operate.

Another object is to provide such an apparatus which allows the operator fully to control the usage thereof so as most effectively to achieve its operational objectives.

Another object is to provide such an apparatus which is adaptable for use in treating a wide variety of work objects using virtually any fluid substance including solvents for removing paint, lacquer, stain, varnish and other substances from a wide variety of types of work objects.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the present invention, in an apparatus having a housing with an interior dimensioned to receive the work object therewithin; a source of fluid under pressure for treating the work object; and an assembly for interconnecting the source and the interior of the housing for release of the fluid under pressure from the source into the interior and against the work object substantially along a predetermined axis.

DESCRIPTION OF THE PREFERRED EMBODIMENT

Figure 1:
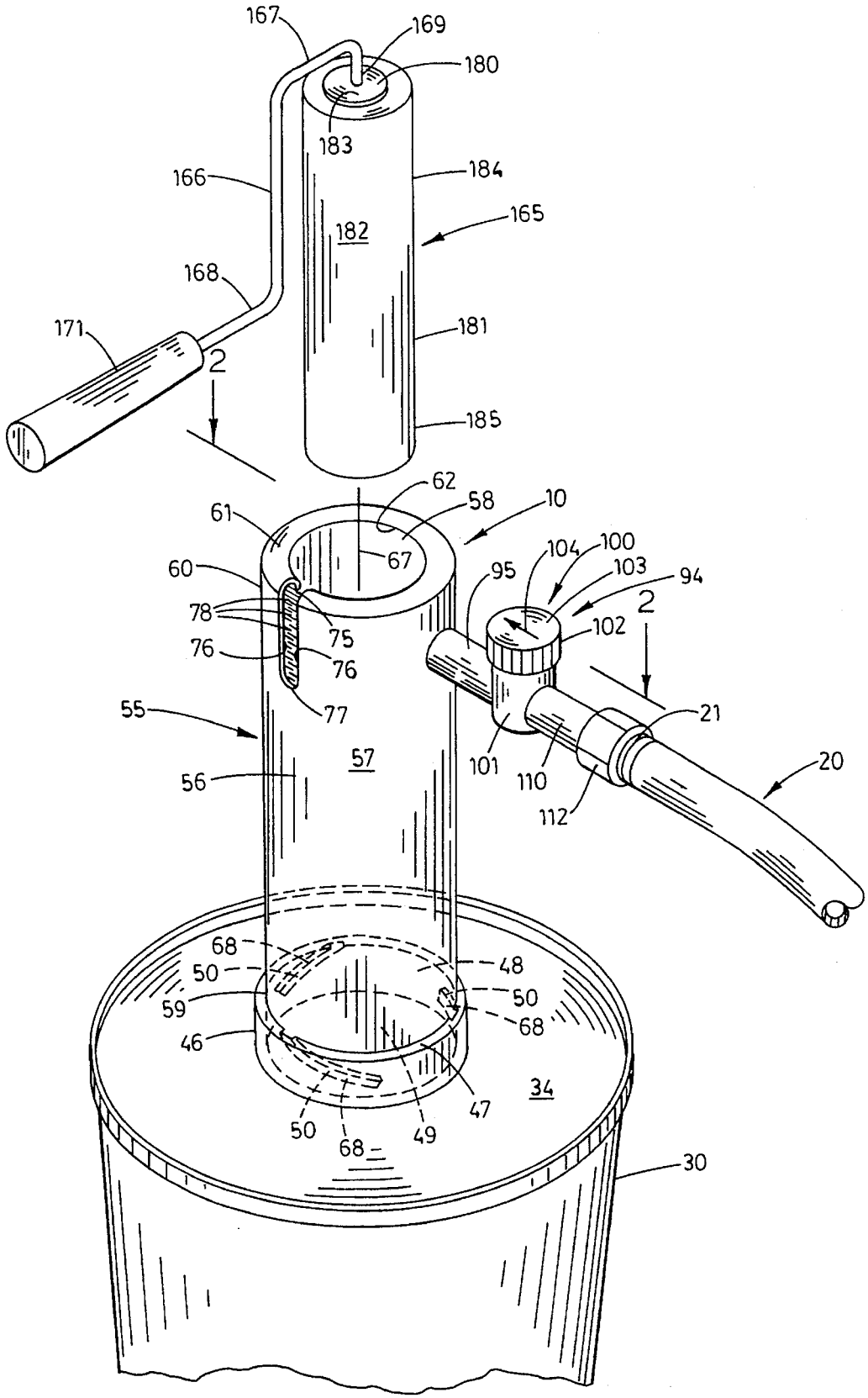
FIG. 1 is a fragmentary perspective view of the apparatus of the present invention shown in a typical operative environment employed in the cleaning of a paint roller.

Referring more particularly to the drawings, the apparatus of the present invention is generally indicated by the numeral 10 in FIG. 1.

As will subsequently become more clearly apparent, the apparatus 10 is operable for use in cleaning a wide variety of types of work objects, but is particularly well suited to cleaning paint rollers. Similarly, the apparatus can be employed in cleaning virtually any substance from such work objects. In the case of substances borne by paint rollers, the apparatus can be employed effectively to remove such substances as paint, stain, lacquer, varnish and the like therefrom. The specific solvent which is employed in the removal of such substances is, of course, dependent upon the substance to be removed. Thus, for oil base substances, paint thinner, lacquer thinner, or another suitable solvent can be employed. However, with the increasing use of water base paints and other surface treatments, water is frequently employed as the solvent of choice. Accordingly, purely for illustrative convenience, it will be understood in the illustrative embodiment that the substance to be removed is a water base paint and that the solvent employed in the cleaning operation is water.

As shown in FIG. 1 and throughout the other views, the apparatus 10 is employed in a representative operative environment interoperating in combination with a conventional water hose 20, fragmentarily shown therein, and having a screw threaded coupling 21 at the terminal end thereof. The hose is connected at the opposite end thereof to a suitable source of water under pressure, such as a faucet or hose bibb not shown.

Figure 3:
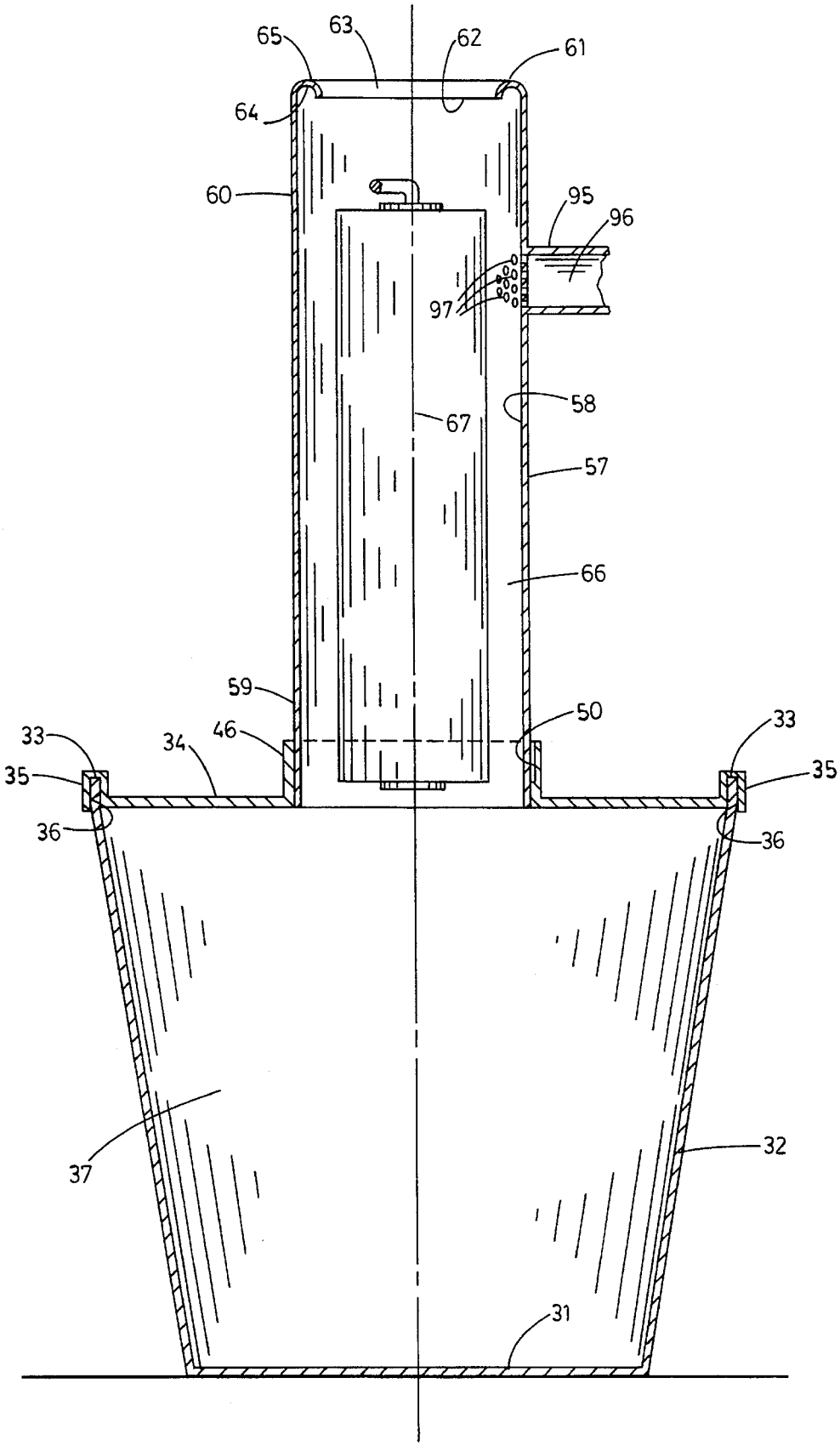
FIG. 3 is a fragmentary, vertical section taken on line 3—3 in FIG. 2.

The apparatus 10 includes a container 30 preferably constructed of plastic. As shown in FIG. 3, the container 30 has a circular bottom wall 31 and a frustoconical side wall 32 extending upwardly and at a slight angle outwardly from the bottom wall 31. The side wall 32 extends to an upper cylindrical annulus 33. A generally circular top or lid 34 is releasably mounted on the side wall 32. The lid 34 has an annulus 35 extending peripherally thereabout with a downwardly facing annular slot 36 therein dimensioned to be releasably snap-fitted over the upper annulus 33 in fluid sealing relation. When so assembled, the container and lid form a fluid tight receptacle 37. The volume capacity of the receptacle 37 can be of any desired size, but, for illustrative convenience, may be visualized as a five (5) gallon capacity.

A cylindrical mount 46 is mounted on and extended from the lid 34 centrally thereof concentric to the annulus 35. The cylindrical mount is preferably integral with the lid and constructed of plastic. The cylindrical mount has an upper annulus 47 and an inner cylindrical surface 48 defining a passage 49 which extends through the lid 34 into communication with the receptacle 37. Three locking grooves 50 are formed in the inner surface 48 of the cylindrical mount in predetermined positions and extend from the upper annulus 47 along the inner surface generally toward the receptacle.

Figure 2:
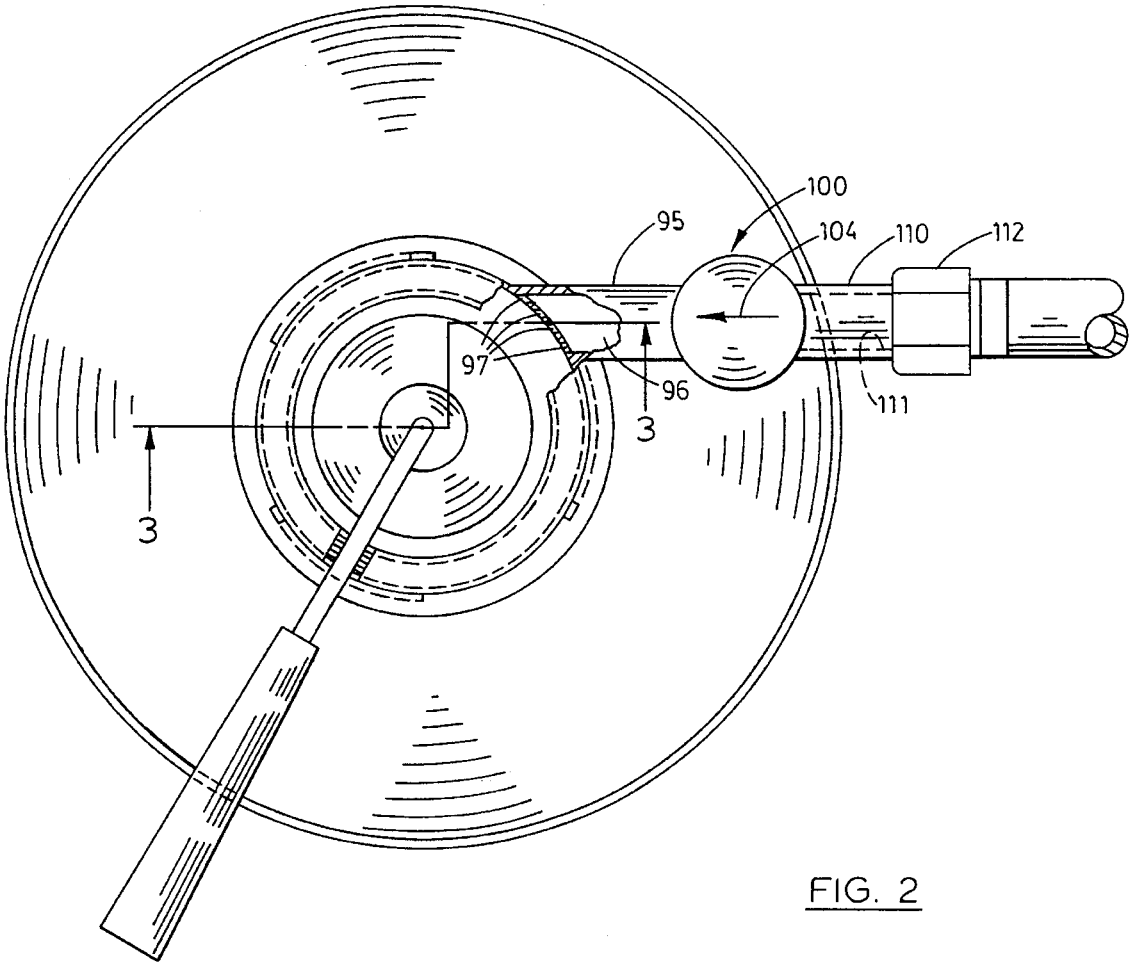
FIG. 2 is a fragmentary, top plan view taken on line 2—2 in FIG. 1.

The apparatus 10 has a cylindrical tube or housing 55 also preferably, but not necessarily constructed of plastic. The housing has a cylindrical wall 56 which is of a length greater than a standard paint roller, as can best be visualized in FIG. 3. The cylindrical wall has an outer surface 57, an inner surface 58, a lower end portion 59 and an upper end portion 60. An annular concavo-convex shield 61 is mounted on and integral with the upper end portion of the housing. The shield extends to a circular lip or annulus 62 bounding a circular opening 63 concentric to the cylindrical wall 56. The shield has an inwardly facing concave surface 64 and an outwardly facing convex surface 65. As shown in FIGS. 2 and 3, the diameter of the opening 63 is only slightly larger than the diameter of a standard paint roller.

The opening 63 communicates with a cylindrical passage 66 defined by the inner surface 58 of the cylindrical wall 56. The cylindrical passage 66 extends entirely through the housing 55, as shown in FIG. 3. The opening 63 and cylindrical passage 66 are concentric to a longitudinal axis of reference 67.

Locking ridges 68 are mounted on and extend outwardly from the outer surface 57 at the lower end portion 59 of the housing in predetermined positions individually slidably receivable in the locking grooves 50 of circular cylindrical mount 46. The housing 55 is thus adapted releasably to be mounted in the cylindrical mount 46 in upstanding relation by means of the individual slidable receipt of the locking ridges in their respective locking grooves. When so mounted, the housing 55 and container are both concentric to the longitudinal axis of reference 67.

A slot 75 is formed in and extends through the shield 61 and upper end portion 60 of the cylindrical wall 56. The slot 75 is bounded by parallel opposite edges 76 and a lower edge or terminus 77. The slot extends along a course parallel to the longitudinal axis of reference 67. A plurality of brush bristles 78 are individually mounted on and extend toward each other from the opposite edges 76. The brush bristles of the opposite edges are interlaced with each other and of sufficient number to form a barrier to fluid discharged thereagainst.

The apparatus 10 has a fluid control assembly generally indicated by the numeral 94 in FIG. 1. The fluid control assembly has a first conduit 95 mounted on the upper end portion 60 of the cylindrical wall 56 at the oblique angle relative thereto best shown in FIG. 2. The first conduit has an internal fluid passage 96. The internal fluid passage communicates with the cylindrical passage 66 of the housing 55 through a plurality of small diameter, cylindrical fluid ports 97 which extend through the cylindrical wall 56 of the housing in a pattern as best shown in FIG. 2. The fluid ports are individually concentric to parallel longitudinal axes which are parallel to the longitudinal axis of the fluid passage 96. Thus, the longitudinal axes of the fluid ports intersect the cylindrical passage 66 of the housing in off set relation to the longitudinal axis of reference 67 as shown in FIG. 2.

A valve assembly 100 is mounted on the first conduit 95 remote from the housing 55. The valve assembly has a valve housing 101 mounted on the first conduit in fluid communication with the fluid passage 96 thereof. A valve member 102 is mounted within the valve housing for manual movement using a control knob 103 through a range of positions between a fully closed position and a fully opened position ninety degrees (90°) removed therefrom. The valve assembly can be of any suitable type, but is preferably constructed of plastic. Indicia 104 in the form of an arrow is provided on the control knob to indicate in which selected position the valve member is disposed. As shown in FIGS. 1 and 2, the valve member is in the fully opened position.

A second conduit 100 is mounted on the valve housing 101 in alignment with the first conduit, as shown in FIG. 2, and having a fluid passage 111 extending therethrough and into fluid supplying relation to the interior of the valve housing. The second conduit mounts a hose coupling 112 for rotational movement thereon for releasable, fluid tight engagement with the screw threaded coupling 21 of the water hose 20. When so connected, the source of fluid under pressure, such as the faucet or hose bibb, not shown, is connected with the cylindrical passage 66 of the housing 55 through the hose 20, second conduit 110, first conduit 95 and fluid ports 97. The flow of fluid therethrough is controlled by the setting of the valve member 102 using the control knob 103.

For illustrative convenience, the apparatus 10 is shown and described herein the cleaning of a standard paint roller 165. The paint roller 165 need only generally be described since it is of standard construction and does not constitute part of the present invention. The paint roller 165 has a primary metal frame 166 having a U-shaped middle portion 167, a first end portion 168, and a second end portion 169. The first end portion 168 mounts a handle 171 thereon. A secondary frame 180 is rotationally mounted on the second end portion 169 of the primary frame 166 at right angles to the first end portion 168. A cylindrical sleeve 181, having an outer surface 182, an inner surface 183, is slidably received on the secondary frame 180 for rotation therewith. The sleeve is constructed of a suitable fabric, plastic sponge material, or any other suitable material. The cylindrical sleeve has an upper portion 184 and an opposite lower portion 185.

OPERATION

The operation of the described embodiment of the present invention is believed to be readily apparent and is briefly summarized at this point.

The apparatus 10 can perhaps most conveniently be considered when assembled in the typical operative environment shown in FIG. 1. The operator turns the control knob 103 to move the valve member 102 to the fully closed position, or, in other words, the arrow of the indicia 104 pointing in a direction ninety degrees (90°) removed from the position shown in the drawings. With the water hose 20 connected to the faucet or hose bibb, not shown, as previously described, the faucet is opened so that water under pressure passes through the water hose 20, into the fluid passage 111 of the second conduit and into the valve assembly 100 where it is stopped by the closed valve member.

Referring more particularly to FIG. 1, the paint roller 165 to be cleaned is inserted in the apparatus 10 by grasping the handle 171 and moving the lower portion 185 of cylindrical sleeve 181 through the opening 63 of the shield 61 and downwardly in the cylindrical passage 66 toward the cleaning position shown in FIG. 3. Simultaneously, the U-shaped middle portion 167 of the primary frame 166 is aligned with slot 75 in the shield and wall 56 of the housing 55. As the cylindrical sleeve 181 is moved to the cleaning position, the U-shaped middle portion moves through brush bristles 78 until it comes to rest at the terminus 77 of slot 75. Upon reaching this point, the paint roller 165 is in the cleaning position shown in FIG. 3 with the upper portion 184 of the sleeve 181 beneath the lip 62 of the shield 61 and in the relationship relative to the fluid ports 97 shown in FIGS. 2 and 3.

The operator then moves the control knob 103 to the position shown in FIGS. 1 and 2 so that the valve member is moved to the fully opened position. Water under pressure is thus released through the valve assembly, along the fluid passage 96 of the first conduit 95 and through the fluid ports 97. The water is forcefully dispersed through the fluid ports in high velocity jets into contact with the outer surface 182 of the sleeve 181. The direction traveled by the jets of water is generally along substantially parallel courses obliquely against the sleeve and eccentric to the longitudinal axis of reference 67. The jets of water striking the sleeve in this oblique manner cause the secondary frame 180 of the paint roller rapidly to be rotated about the second end portion 169 of the primary frame. The centrifugal forced resulting from this rapid rotation assists in throwing the residual paint borne by the sleeve therefrom and otherwise dislodging the residual paint. The jets of water directly contacting the sleeve flush the residual paint therefrom entirely about the sleeve as it rotates. The water cascades down the sleeve as it is rotated and splashes off of the inner surface 58 of the housing and back onto the sleeve. It has been discovered that the relatively violent action of the water within the cylindrical passage 66 and about the sleeve operate effectively to clean substantially all residual paint from the sleeve. Since the paint is of a water base, it is of course soluble in the water. As a consequence, the cascading water dissolves the paint and thus flushes it from the sleeve.

The shield 61 of the apparatus 10 operates to redirecting the water projected thereagainst back downwardly into the passage 66 within the housing to prevent release from the housing through the opening 63. The brush bristles 78 extending across the slot 75 also act as a barrier to the water and residual paint. Thus, the operator and the environment are protected from contact with the water and paint residue.

If desired, although it is not necessary, the operator can grasp the handle 171 of the paint roller 165 and slowly move it upwardly as the cleaning operation continues. This causes all of the sleeve to be drawn directly through the high velocity jets of water so as to ensure that all of the paint residue is removed from the sleeve. During such movement, the shield 61 and brash bristles 78 continue to operate as described as a barrier to release of the water and paint residue from the housing.

During the entire cleaning operation, the water and paint residue flow downwardly in the cylindrical passage and into the receptacle 37 of the container 30. Thus, all of this waste material is collected in the container isolated from the environment. After the cleaning operation, it can then be disposed of in any manner provided by law. This may include pouring the waste material into other sealed containers for disposal or sealing the container, after removal of the lid 34, using another sealed lid, not shown. In any case, the waste material never comes in contact with the operator or the environment.

Before the paint roller 165 is removed from apparatus 10, the control knob 103 of the valve assembly 100 is returned to the closed position. The paint roller is removed from the apparatus by grasping handle 171 and lifting the paint roller 165 upwardly from the housing 55. The housing is disconnected from the lid 34 by rotating it to slide the locking ridges 68 from their respective locking grooves 50. As noted, the contents of container 30 can then be disposed of through the passage 49, or, if desired, the lid 34 can be removed from the container by separating the upper annulus 33 from the annular slot 36 of the lid. The container can then be emptied and cleaned for reuse as desired.

Therefore, the apparatus for treating work objects of the present invention is particularly well suited to the cleaning of paint rollers and the like; is operable to treat the paint roller with a treating substance such as a suitable solvent, with sufficient velocity completely to remove the residual substances from the paint roller; operates in such a fashion as to confine the cleaning solvents therewithin to prevent inadvertent release into the environment or on to the operator; possesses a fully reliable means for disposing of the waste materials resulting therefrom in accordance with local, state and federal laws; and is otherwise entirely successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for cleaning residual substances from the sleeve of a paint roller which has a handle having a mount borne for rotational movement substantially about a longitudinal axis and mounting said sleeve thereon for rotation with the mount substantially about said longitudinal axis, the apparatus comprising:

A. a substantially cylindrical housing, having upper and lower end portions, a substantially cylindrical passage of predetermined diameter extending through the housing along a longitudinal axis of reference and the upper and lower end portions thereof through annular openings of predetermined diameter, dimensioned substantially fully to receive the mount and sleeve of the paint roller therewithin in a predetermined cleaning position substantially concentric to said passage of the housing;

B. an annular shield mounted on the upper end portion of the housing overhanging the opening thereof having a concave surface substantially facing said cleaning position and extending to an annulus bounding a substantially circular entrance opening communicating with said cleaning position in substantially axial alignment with said longitudinal axis of reference;

C. a conduit mounted on the upper end portion of the housing communicating with the cleaning position thereof through a plurality of fluid ports along substantially parallel axes substantially right-angularly related to and offset relative to said longitudinal axis of reference;

D. a valve assembly, adapted for connection to a source of fluid under pressure, mounted on said conduit and operable to control the volume of fluid passing from the source of fluid under pressure through said conduit and through said plurality of fluid ports; and E. a sealing assembly mounted on the upper end portion of the housing defining a passage extending through said shield and inwardly of the upper end portion of the housing along a course substantially parallel to said longitudinal axis of reference to a terminus engageable by said handle of the paint roller, when the mount and sleeve thereof are received in said cleaning position, to support the paint roller in said cleaning position and including a plurality of bristles interlaced in said passage substantially to seal the passage against release of fluid therethrough whereby a paint roller, disposed in said cleaning position with the handle thereof in said sealing assembly has said residual substances removed therefrom by fluid under pressure released by the valve assembly through said fluid ports against the sleeve to rotate the mount of the paint roller about said longitudinal axis thereof so as to remove said residual substances by the flushing action of said fluid under pressure and by centrifugal force in rotation of the mount substantially about said longitudinal axis.

2. The apparatus of claim 1 including a substantially fluid tight container for receiving residual fluid and said residual substances therewithin and means for interconnecting the lower end portion of the housing and said container for the gravitational receipt of said residual fluid and residual substances in the container for disposal.

3. The apparatus of claim 2 wherein said interconnecting means includes mating screw threads individually borne by the container and the lower end portion of the housing releasably engageable to mount said housing on the container in gravitationally feeding relation thereto.

4. An apparatus for cleaning a substantially cylindrical work object of predetermined diameter which is rotational substantially about a longitudinal axis and has a handle, the apparatus comprising a substantially cylindrical housing having an interior surface substantially concentric to an axis of reference and bounding a chamber having a diameter less than twice the diameter of the work object to receive one of said work objects therewithin in a cleaning position with its longitudinal axis substantially in coincidence with said axis of reference, fully contained within said housing and for rotation substantially about said longitudinal axis; means communicating with said interior of the housing for projecting fluid under pressure against the work object during operation along a course eccentric to said longitudinal axis to cause the work object to spin substantially about said longitudinal axis for cleaning thereof; and an annular shield mounted on the housing substantially concentric to said axis of reference and defining an entrance opening for movement of the work object therethrough to and from said cleaning position and having a concave surface substantially concentric to said axis of reference facing said cleaning position extending about the entrance opening whereby fluid under pressure is substantially contained within the cleaning position by deflection of fluid from said concave surface substantially toward said cleaning position and wherein a slot is formed in said housing extending along a course substantially parallel to said axis of reference and intersecting said shield for movement of the handle therealong in movement of the work object to and from said cleaning position and including bristles interlaced in said slot substantially to preclude the release of fluid through the slot from the cleaning position during operation of the projection means.

* * * * *

UNITED STATES PATENT AND TRADEMARK OFFICE

CERTIFICATE OF CORRECTION

PATENT NO. : 5,544,668

DATED : August 13, 1996

INVENTOR(S) : ARTHUR J. DOLLAR

It is certified that error appears in the above-identified patent and that said Letters Patent is hereby corrected as shown below:

Column 6, line 52, delete "brash" and substitute

---brush---.

Signed and Sealed this

Twenty-second Day of October, 1996

*Attest:*

*Attesting Officer*

BRUCE LEHMAN

*Commissioner of Patents and Trademarks*